US008264415B2

(12) United States Patent
Winkler et al.

(10) Patent No.: US 8,264,415 B2
(45) Date of Patent: Sep. 11, 2012

(54) SEALED TRANSMITTER ASSEMBLY FOR SUBSURFACE UTILITY INSTALLATIONS

(75) Inventors: Patrick Winkler, East Troy, WI (US); Jin Hao, Fox Point, WI (US); Eric Metzger, Franklin, WI (US)

(73) Assignee: Badger Meter, Inc., Milwaukee, WI (US)

( * ) Notice: Subject to any disclaimer, the term of this patent is extended or adjusted under 35 U.S.C. 154(b) by 782 days.

(21) Appl. No.: 12/355,237

(22) Filed: Jan. 16, 2009

(65) Prior Publication Data

US 2010/0182162 A1 Jul. 22, 2010

(51) Int. Cl.
*H01Q 1/04* (2006.01)
*H01Q 1/42* (2006.01)
*H01Q 1/24* (2006.01)

(52) U.S. Cl. ..... 343/719; 343/872; 343/702

(58) Field of Classification Search ..... 343/702, 343/719, 872, 846

See application file for complete search history.

(56) References Cited

U.S. PATENT DOCUMENTS 5,298,894 A 3/1994 Cerny et al.
5,519,387 A 5/1996 Besier et al.
5,825,303 A * 10/1998 Bloss et al. ..... 340/870.02
5,877,703 A 3/1999 Bloss, Jr. et al.
6,218,995 B1 * 4/2001 Higgins et al. ..... 343/719
6,525,620 B1 * 2/2003 Barabash ..... 333/24 C
7,412,882 B2 8/2008 Lazar et al.
7,903,034 B2 * 3/2011 Anguera et al. ..... 343/702

* cited by examiner

*Primary Examiner* — Jacob Y Choi
*Assistant Examiner* — Hasan Islam
(74) *Attorney, Agent, or Firm* — Boyle Frederickson, S.C.

(57) ABSTRACT

An assembly (10) for installation in a subsurface ground enclosure has an electronic transmitter, an antenna and other circuitry that are encapsulated against moisture conditions. The assembly (10) comprises a circuit board (31) supporting radio frequency transmitter circuitry, the circuit board (31) having at least two orthogonal edges (31*b*, 31*c*), an antenna (14, 15) having two 90-degree bent portions extending from orthogonal edges (31*b*, 31*c*) of the circuit board (31), a housing bottom portion (11) with an internal barrier (18) separating an L-shaped antenna compartment (13) adjacent two sides of the circuit board (31) from a battery compartment (16) underneath the circuit board (31), sealing material for encapsulating the circuit board (31) and the batteries (17) in the battery compartment (16), and a cover (20) that protects the antenna compartment (13) from entry of the sealing material.

11 Claims, 3 Drawing Sheets

SEALED TRANSMITTER ASSEMBLY FOR SUBSURFACE UTILITY INSTALLATIONS

TECHNICAL FIELD

This invention relates to automatic meter reading (AMR) systems for collecting meter data signals over a geographical area, such as a municipality or municipal utility district, and more particularly to transmitter assemblies for location in subsurface enclosures installed in the ground.

DESCRIPTION OF THE BACKGROUND ART

In moderate climate zones, utility meters, particularly water meters, are located in subsurface ground enclosures in areas near residences or other dwellings. Such enclosures are referred to as "pits." An example of such enclosure is illustrated in Cerny et al., U.S. Pat. No. 5,298,894, issued Mar. 29, 1994, and assigned to the assignee of the present invention. In these systems, a transmitter or transceiver, and an associated antenna, are enclosed in one or more sealed enclosures which are located in a larger pit for the water meter. In Cerny et al., the antenna was disposed in an upper compartment and the electronics was installed in a lower compartment with a double seal between the two parts.

A primary issue concerning all remote meter systems, whether used in pit installations or elsewhere, is their resistance to weather, and to submersion in the event that the pit fills with water. Therefore, the invention provides a device that is very resistant to moisture conditions in its operating environment. Typically, the data storage device is powered by one or more batteries, which must also be contained in a sealed enclosure.

In Bloss, Jr. et al., U.S. Pat. No. 5,877,703, a utility meter transmitter assembly has three vertically arranged compartments with a lowermost compartment receiving potting material to seal some wire entry points. A portion of potting material was injected through a port into the bottom compartment. A battery was encapsulated separately in a battery assembly that was inserted into a lower compartment from the bottom. In Bloss, Jr. et al., U.S. Pat. No. 5,825,303, the housing for the electronics is provided by a tube and the encapsulating material is injected through a bottom opening to encapsulate the electronic circuit board and the battery. Bublitz et al., U.S. Pat. No. 6,378,817 discloses a bracket for mounting components in a subsurface ground enclosure.

The present invention provides an improved method of encapsulation and an improved sealed transmitter assembly for installation in a subsurface ground enclosure. As with other electronic devices, there is a desire to make the devices smaller in size, lower in the cost of manufacture, and easier to service in the field.

Here, it is required that the transmitter be suitable for fixed installations and therefore utilize more power and radiating energy, so as to transmit over longer distances than in a mobile system. This requires a somewhat larger antenna. The technical problem is how to accommodate the large antenna and the batteries in a small size, sealed package.

SUMMARY OF THE INVENTION

The invention provides an assembly and method for sealing an electronic transmitter, antenna and other circuitry for installation in a subsurface ground enclosure.

The assembly comprises a circuit board supporting radio frequency transmitter circuitry, the circuit board having at least two orthogonal edges; an antenna having two antenna extension portions extending from the two orthogonal edges of the circuit board; a housing for enclosing the circuit board and the antenna, in which the housing has a barrier separating an antenna compartment adjacent the circuit board from a battery compartment underneath the circuit board; a separate cover that is disposed over the antenna compartment; and a flowable material for sealing around the cover and the printed circuit board and for filling in the battery compartment to protect against moisture, wherein the cover prevents the flowable material from entering the antenna compartment.

The invention provides encapsulation for the electronic parts while preventing encapsulation material from impairing the function and operation of the antenna.

It is a further aspect of the invention that the antenna has a greater surface area than the circuit board. The antenna is provided by two L-shaped members extending from the orthogonal edges of the circuit board and then downwardly into the L-shaped antenna compartment.

This provides a transmitter with power for reaching receivers in a fixed network while keeping the size of the assembly very compact.

In the method of the invention the circuit board is disposed on the barrier and over the battery compartment with the portions of the antenna extending form edges of the circuit board into portions of the antenna compartment. A separate cover is placed into the housing and over the antenna compartment, and encapsulating material is injected into the housing, above and below the circuit board and through a gap between one edge of the circuit board and an inside wall of the housing. This material encapsulates the battery and circuit board while leaving the antenna in an unfilled space.

Other aspects of the invention, besides those discussed above, will be apparent to those of ordinary skill in the art from the description of the preferred embodiments which follows. In the description, reference is made to the accompanying drawings, which form a part hereof, and which illustrate examples of the invention.

DETAILED DESCRIPTION OF THE PREFERRED EMBODIMENT

Figure 1:
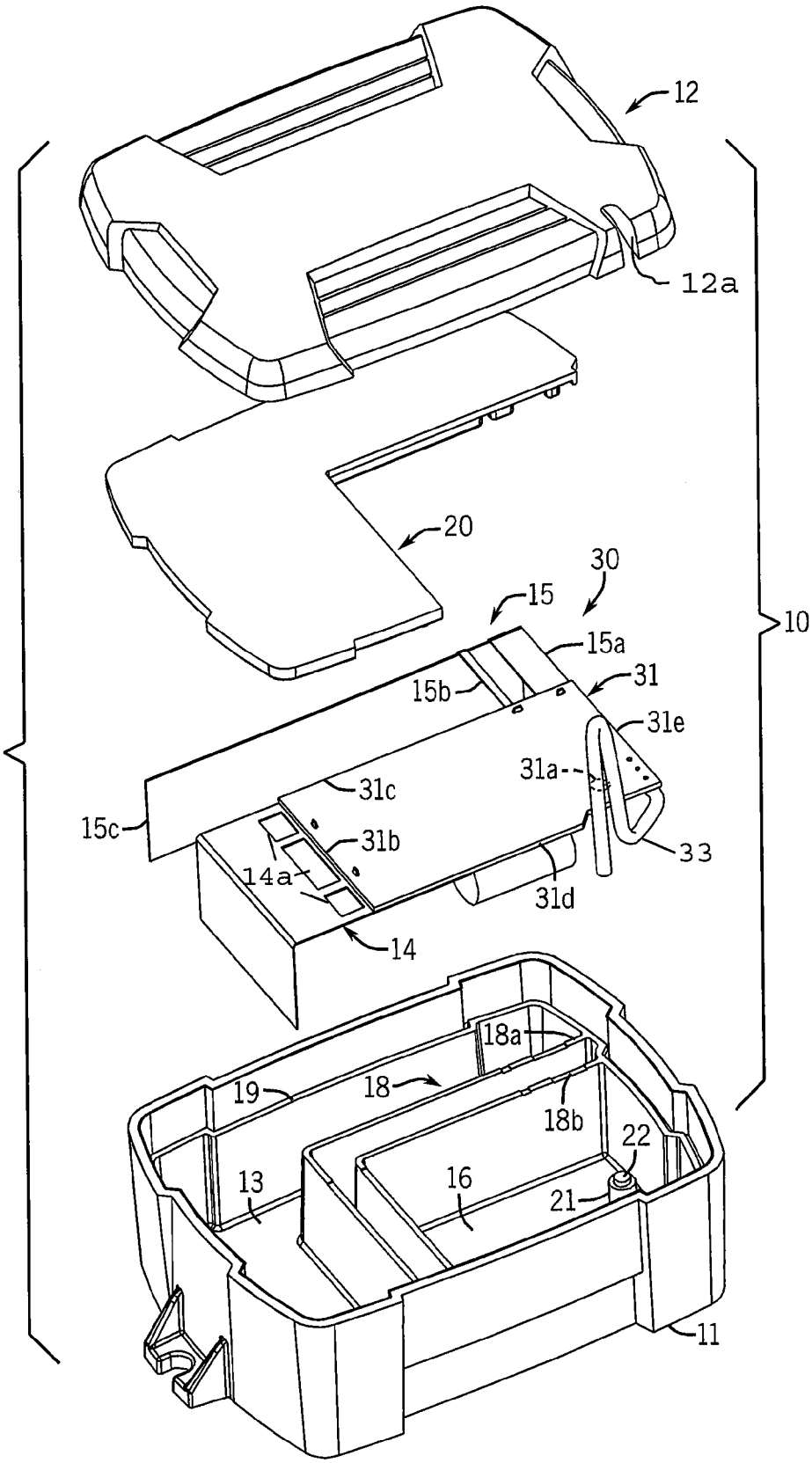
FIG. 1 is an exploded perspective view of the assembly of the present invention.
Figure 3:
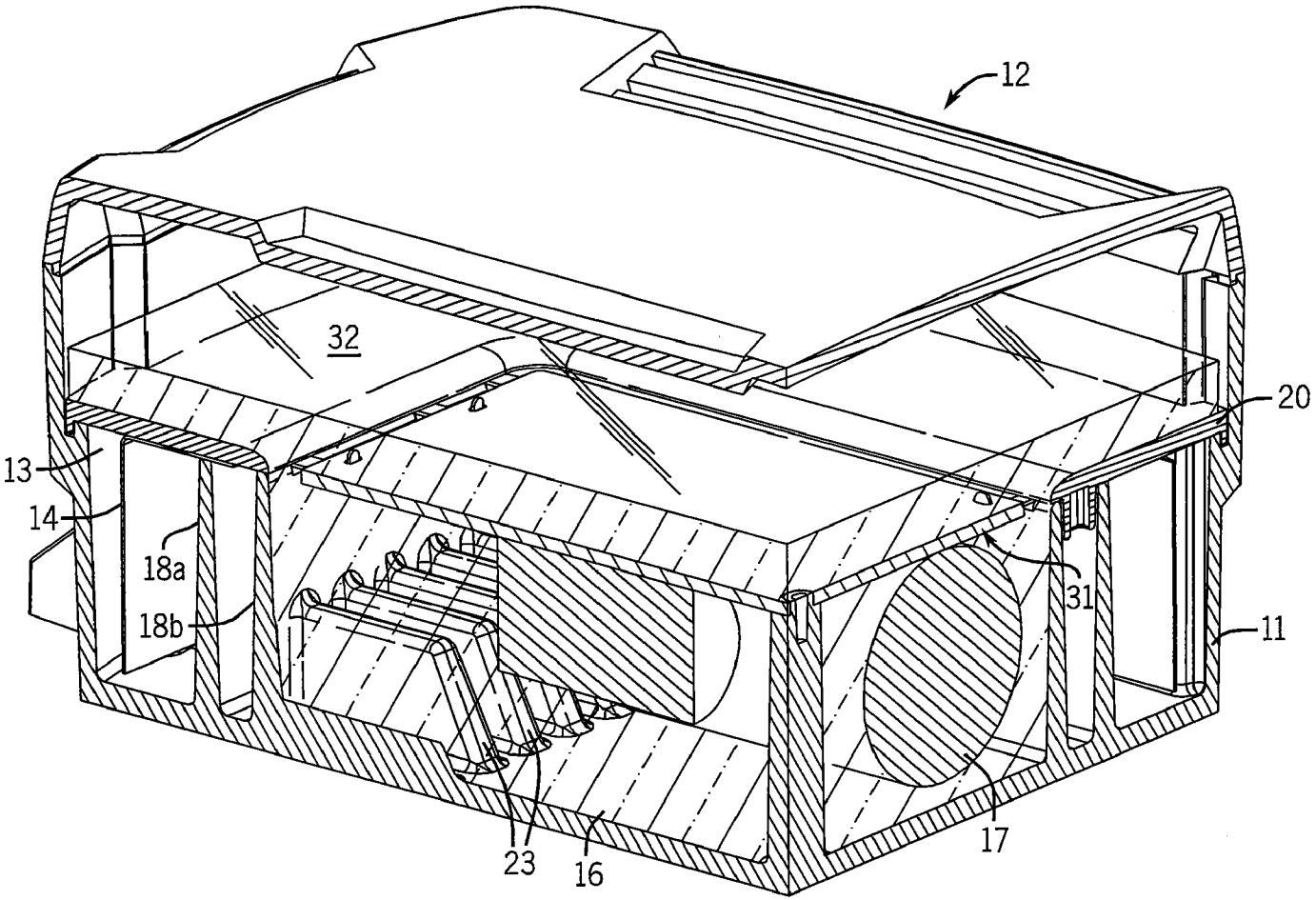
FIG. 3 is a view of a 90-degree section through the completed assembly, showing the encapsulating material.

Referring to FIG. 1, the assembly 10 of the present invention has a housing with a bottom portion 11 and a lid 12. The housing bottom portion 11 has an L-shaped antenna compartment 13 for receiving the antenna 14, 15 and a rectangular battery compartment 16 for receiving at least one battery 17 and an upstanding L-shaped interior barrier 18 of at least two upstanding spaced apart and parallel walls 18*a*, 18*b*, separating the antenna compartment 13 and the battery compartment 16. The spacing in the antenna compartment 13 between the walls 18*a*, 18*b* and the outer wall of the housing bottom portion 11 has been slightly exaggerated in FIG. 1 in comparison with FIG. 3 which is closer to the correct proportion. Inside the battery compartment, as seen in FIG. 3, a plurality of ribs 23 extend along a floor of the housing bottom 11 to one inner side of the barrier wall 18*b*.

The barrier 18 will help support a circuit board assembly 30. In addition, a post 21 in FIG. 1 is situated in the battery compartment 16 with a projection 22 that is received in a hole 31*a* in the circuit board 31, when the circuit board 31 is placed into its assembled position. Inside the housing bottom portion is an interior ledge 19 for an L-shaped cover 20 seen in FIG. 1. A cable 33 enters the housing through a slot opening 12*a* in the lid 12 and connects to the circuit board 31 near edge 31*e*. The circuit board 31 receives signals from a meter register or meter encoder through the cable 33 representing units of consumption of a utility, and these are converted to radio frequency signals for transmission through the antenna 14, 15.

Figure 2:
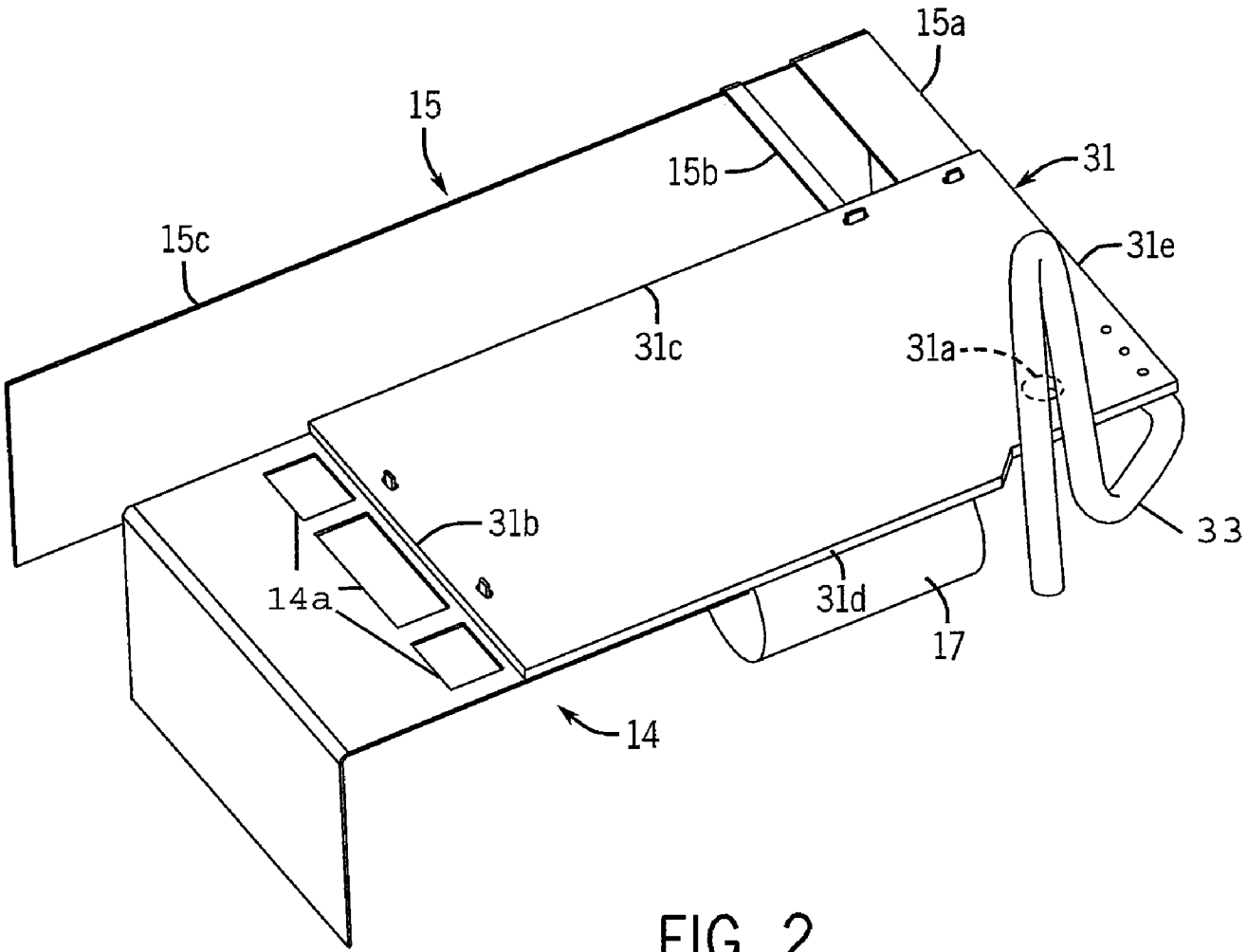
FIG. 2 is detail perspective view of the circuit board portion of the assembly.

A circuit board assembly 30 includes a circuit board 31 with circuitry for a radio transmitter. Although the invention is disclosed in the context of a transmitter, it is also applicable to a transmitter combined with a receiver ("transceiver") for two-way communication, the term "transmitter should be understood to include a part of a transceiver. An L-shaped ground plane element 14 (FIG. 2) of conductive material extends from one edge 31*b* of the circuit board 31 and has a portion bent at a 90-degree angle to the extending portion. The L-shaped element 14 has some cut-out portions 14*a* near the edge 31*b* of the circuit board 31. An F-shaped radiating element 15 FIG. 2) extends from another edge 31*c* of the circuit board 31 that is orthogonal to the first edge 31*b*. The F-shaped element 15 includes a wider top bar 15*a*, which serves as a shorting member, and a narrower middle bar 15*b* that serves as a conductive member for the radiating energy to a broad, flat, F-stem strip 15*c* that is bent at a 90-degree angle to the two cross bars 15*a*, 15*b*. The antenna 14, 15 extends from two orthogonal edges 31*b*, 31*c* of the circuit board 31 with two portions at approximately ninety degrees from the plane of the circuit board 31 to provide a compact area-to-height aspect ratio. Although gain is reduced by the bending the two portions, it is more than made up for by the added length of the ground plane 14. The F-shaped element and the L-shaped element are preferably made of a conductive metallic sheet material. Reference is also made to a U.S. patent application entitled "Antenna for Sealed Transmitter Assembly for Subsurface Utility Data Transmitters," filed concurrently herewith and assigned to the assignee herein, which disclosure is incorporated herein by reference.

The battery 17 is encapsulated with a sealing material (FIG. 3) in the battery compartment 16 and the interior barrier 18 forms a support for the printed circuit board 31 as well as a barrier against the intrusion of sealant into the antenna compartment 16 in which the antenna 14, 15 is disposed when the unit 10 is assembled. An internal cover element 20 is disposed around the printed circuit board 31 and over the antenna compartment 13 and the antenna 14, 15 to provide a second barrier against the entry of sealing material into the antenna compartment 13.

A sealing material 32 is disposed in the battery compartment 16, as seen in FIG. 3, to protect the battery 17 from moisture. Sealing material 32 is also disposed on both sides of the circuit board 31 and at the location where an edge of the cover element 20 meets an inner wall of the housing bottom portion 11. The sealing material is not disposed in the antenna compartment 13 or in contact with the antenna 14, 15, except along the edges of the circuit board 31, so as not to affect the operation of the antenna 14, 15, due to a capacitive effect that the material would have on the electrical properties of the antenna 14, 15. Encapsulation of the electronics is necessary, because the outer housing of thermoplastic material 11, 12, is not water impervious.

In the method of the invention, the circuit board assembly 30 is positioned over the barrier 18 within a housing bottom portion 11. The portions of the antenna 14, 15 extending from edges 31*b*, 31*c* of the circuit board are placed into corresponding portions of the antenna compartment 13. The cover 20 is positioned around the circuit board 31 and over the antenna compartment 13 to shield the antenna compartment 13 from most of the encapsulating material. Encapsulating material is injected through the opening at the top into the housing bottom portion 11 into the space above the circuit board 31 and down around the edges 31*d*, 31*e* of the circuit board 31. The edges 31*d* and 31*e* of the circuit board 31 are separated by a gap from the outer wall of the housing bottom portion 11 such that encapsulating material flows into the battery compartment 16, and fills the battery compartment 16 to cover the battery 17 and encapsulate the bottom side of the circuit board 31 as seen in FIG. 3. The encapsulant, also referred herein to as sealing material, then fills to a level about the circuit board 31 to seal the top side thereof. Inside the battery compartment 16, the battery 17 or batteries and the cable 33 (not seen in FIG. 3) are encapsulated in the material, and the material fills any seam between the sealing cover 20 and inside wall of the bottom housing portion 11 and any gap between the circuit board 31 and the inside wall of the housing bottom portion 11. The housing lid 12 is then placed over the housing bottom portion 11 to enclose the assembly 10. It may be secured to the housing bottom 11 by a snap fit or other known methods.

Once the assembly 10 is assembled it can be installed in a subsurface utility enclosure of a type shown and described in the prior art cited above, with the use of a bracket that mounts the assembly 10 some distance under the pit lid or by fastening the assembly directly underneath the pit lid. It is assumed in this example that the pit lid is made of a non-metallic material that does not interfere with radio signals to any great extent.

From this description, it can be seen how the invention provides a compact transmitter/antenna unit having an antenna of much larger size that the prior art. The invention also utilizes a side-by-side arrangement of compartments instead of the stacked arrangement of the prior art.

This has been a description of a preferred embodiment, but it will be apparent from the above description that variations of a type that are apparent to one of ordinary skill in the art may be made in the details of other specific embodiments without departing from the scope and spirit of the present invention, and that such variations are intended to be encompassed by the following claims.

We claim:

1. A radio frequency transmitter assembly for disposition in a subsurface utility enclosure, the assembly comprising:

a circuit board supporting radio frequency transmitter circuitry, the circuit board having at least two orthogonal edges;

an antenna having two antenna extension portions extending from the two orthogonal edges of the circuit board, the antenna extension portions having two respective portions bent at approximately ninety degrees from the plane of the circuit board to provide a compact lateral area for the assembly without increasing a height of the assembly;

a housing for enclosing the circuit board and the antenna, wherein the housing has a barrier separating a battery compartment underneath the circuit board from an antenna compartment which is adjacent the circuit board and which contains the two respective portions of the antenna bent at ninety degrees from the plane of the circuit board;

wherein a gap is formed between one edge of the circuit board and an interior wall of the housing;

wherein the housing has a top cover for closing the housing;

an antenna compartment cover that is enclosed within the housing, that is separate from housing top cover and that is disposed over the antenna compartment; and a flowable material for sealing around the antenna compartment cover and an exposed top side of the circuit board, said flowable material filling in the battery compartment through the gap between one edge of the circuit board and an interior wall of the housing to seal a bottom side of the circuit board and to protect against moisture entering the battery compartment, wherein the antenna compartment cover prevents the flowable material from entering the antenna compartment.

2. The radio frequency transmitter assembly as recited in claim 1, wherein the battery compartment is rectangular and wherein the antenna compartment is L-shaped and is disposed around two sides of the rectangular battery compartment; and wherein a first one of the antenna extension portions includes a L-shaped ground plane portion extending laterally from one of the two orthogonal edges of the circuit board and then turning downwardly into a first portion of the L-shaped antenna compartment.

3. The radio frequency transmitter assembly as recited in claim 2, wherein a second one of the antenna extension portions includes a F-shaped radiating element extending laterally from a second of the two orthogonal edges of the circuit board and then turning downwardly into a second portion of the L-shaped first compartment.

4. The radio frequency transmitter assembly as recited in claim 1, further comprising an L-shaped cover for covering the antenna compartment to prevent entry by the flowable material.

5. The radio frequency transmitter assembly as recited in claim 1, wherein the barrier comprises at least two spaced apart upstanding walls.

6. The radio frequency transmitter assembly as recited in claim 1, wherein the housing is made of a thermoplastic material.

7. The radio frequency transmitter assembly as recited in claim 1, wherein the housing includes an opening receiving a cable to connect to the printed circuit board to provide signals representing units of consumption of a utility.

8. A method of making a sealed transmitter assembly for disposition in a subsurface utility enclosure, the assembly comprising:

positioning an assembly that includes a circuit board over an upstanding barrier within a housing bottom portion, the barrier separating a battery compartment from an antenna compartment;

wherein an antenna that extends from two orthogonal edges of the circuit board has two portions bent at approximately ninety degrees from the plane of the circuit board;

positioning the bent portions of an antenna into portions of the antenna compartment;

placing a compartment cover that is separate from a top cover of the housing, into the housing and around the circuit board and over the antenna compartment, the compartment cover shielding the antenna compartment from encapsulating material; and flowing encapsulating material into the housing bottom portion and past the compartment cover into the battery compartment, and above and below the circuit board and through a gap formed between one edge of the circuit board and a wall of the housing to seal the circuit board without contacting the antenna so as to effect its operation.

9. The method of claim 8, wherein the encapsulating material is flowed into the bottom housing portion from above.

10. The method of claim 9, wherein the encapsulating material rises to a height above the circuit board, but not up to the top opening of the housing bottom portion.

11. The method of claim 8, further comprising securing the top cover of the housing over the housing bottom portion to fully enclose the circuit board and the antenna.

* * * * *